United States Patent [19]

Salomon

[11] 4,345,776

[45] Aug. 24, 1982

[54] SAFETY BINDING FOR SKI

[75] Inventor: Georges P. J. Salomon, Annecy, France

[73] Assignee: Etablissements Francois Salomon & Fils, Annecy, France

[21] Appl. No.: 156,622

[22] Filed: Jun. 5, 1980

[30] Foreign Application Priority Data

Jun. 6, 1979 [FR] France ..... 79 14484

[51] Int. Cl.³ ..... A63C 9/08

[52] U.S. Cl. ..... 280/629; 280/626

[58] Field of Search ..... 280/629, 628, 630, 627, 280/626, 623, 611

[56] References Cited

U.S. PATENT DOCUMENTS

| | | | |
|---|---|---|---|
| 3,544,122 | 12/1970 | Hvam | 280/11.35 |
| 3,595,595 | 7/1971 | Axthammer | 280/629 |
| 3,822,071 | 7/1974 | Mottet | 280/625 |
| 3,902,728 | 9/1975 | Salomon | 280/629 |
| 4,170,372 | 10/1979 | Salomon | 280/628 |
| 4,178,014 | 12/1979 | Salomon | 280/629 |

FOREIGN PATENT DOCUMENTS

| | | | |
|---|---|---|---|
| 2655896 | 6/1977 | Fed. Rep. of Germany | 280/629 |
| 1342739 | 9/1962 | France . | |
| 1336976 | 6/1964 | France . | |
| 1446497 | 6/1966 | France . | |
| 2334382 | 2/1977 | France . | |

*Primary Examiner*—Joseph F. Peters, Jr.
*Assistant Examiner*—Milton L. Smith
*Attorney, Agent, or Firm*—Sandler & Greenblum

[57] ABSTRACT

A safety binding adapted to be mounted on a ski for holding a ski boot thereon, wherein one of the parts, jaw or part connected to the jaw, is applied on the support means at three points, namely an upper point disposed in the longitudinal plane of symmetry of the binding and two lower points of support symmetrical with respect to this plane, the points thus defining the two lines of support, disconnection being effected by pivoting either on one of the lines of support, or on the other.

25 Claims, 14 Drawing Figures

SAFETY BINDING FOR SKI

BACKGROUND OF THE INVENTION

The present invention relates to a safety binding adapted to be mounted on a ski to hold a ski boot thereon.

Safety bindings, also called front stops, are already known, which comprise a one-piece jaw in which the front portion of the sole of a ski boot is engaged and maintained. In these bindings, of the rocking kinematics type, the jaw is maintained applied, directly or indirectly, against a support means connected to the ski. The binding comprises two lines of support disposed on either side of the longitudinal plane of symmetry of the ski. The jaw is urged forwards under the action of an elastic member and consequently it may pivot on one or the other of the lines of support, when the skier's foot is subjected to a torsional strain in one direction or the other, to ensure disconnection.

In particularly advantageous embodiments of these safety bindings, the lines of support are provided to converge at a point located above the ski. This particular arrangement of the lines of support of the jaw offers the advantage that the latter, in the course of its pivoting movement about one of the lines of support during release, lifts slightly in the direction of release, this lifting virtually annuling friction resulting from to the vertical load of the binding during lateral release and consequently does not increase the force required for release effort.

SUMMARY OF THE INVENTION

The present invention relates to improvements in safety bindings of the type with convergent lines of support, with a view to obtaining a particularly simple and advantageous construction especially in the case where the jaw which holds the boot is adjustable in height in order to be adapted to different sole thicknesses. To this end, the safety binding comprises a jaw which engages and maintains one end of the sole of a ski boot; and an elastic mechanism in abutment at one of its ends on a support fixed to the ski and at the other end on a part connected to the jaw to urge the jaw in the direction of the support means fixed to the ski, directly or by means of an intermediate element connected to the jaw. Two lines of support which are symmetrical with respect to the longitudinal plane of symmetry of the binding are provided which converge at a point located above the ski. The lines of support are defined on the rear face of the support fixed to the ski. One of the parts, i.e. the jaw or an intermediate element connected to the jaw, is applied against the support means at three points, namely an upper point of support disposed in the longitudinal plane of symmetry of the binding and two lower points of support symmetrical with respect to this plane. The points thus define two lines of support, with release being effected by pivoting on either one of the lines of support.

According to another feature of the present invention, the jaw bears on the upper point of support via a screw for adjusting height, carried by this jaw.

BRIEF DESCRIPTION OF THE DRAWINGS

The invention will be more readily understood on reading the description with reference to the accompanying drawings, in which.

DESCRIPTION OF THE PREFERRED EMBODIMENTS

Figure 1:
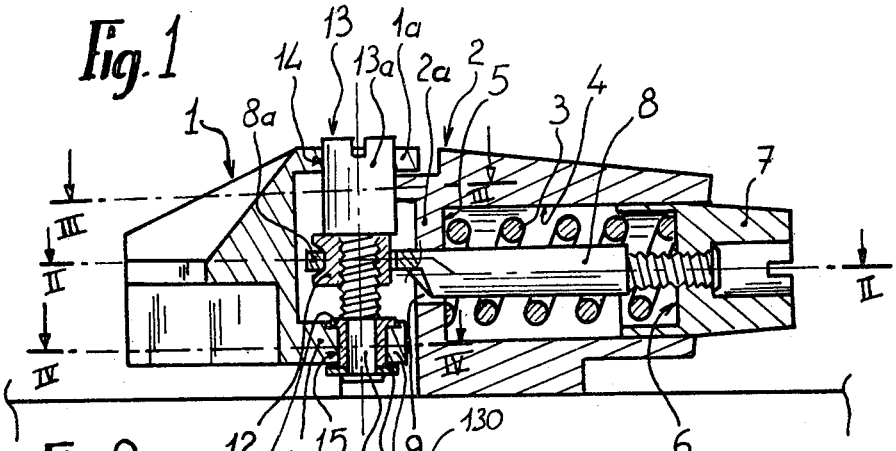
FIG. 1 is a view in vertical, axial section of a safety binding according to the invention, in rest position.
Figure 2:
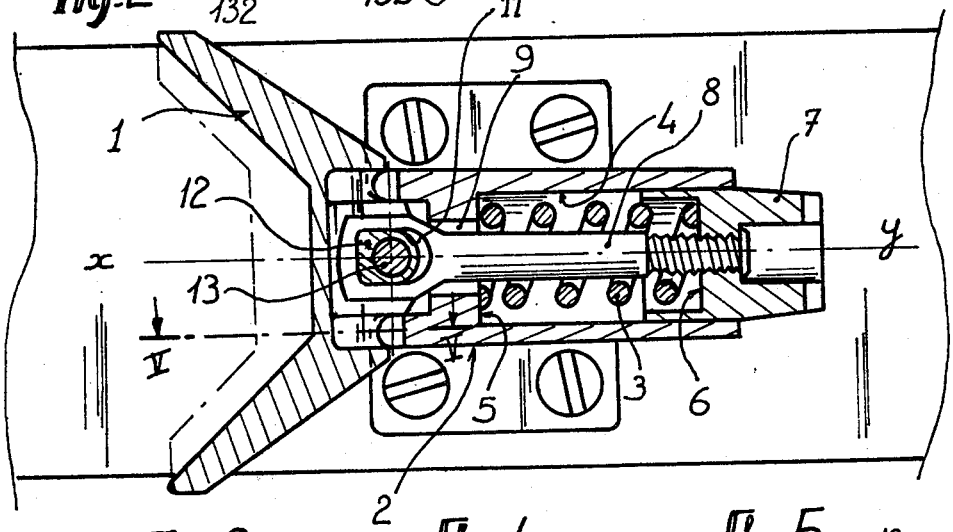
FIG. 2 is a view in horizontal section along the line II—II of FIG. 1.
Figure 3:
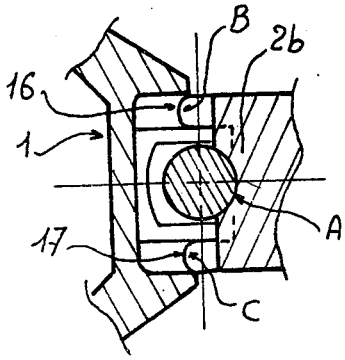
FIG. 3 is a view in horizontal section along line III—III of FIG. 1.

Referring now to the drawings, the safety binding shown in FIGS. 1 to 7 essentially comprises two parts which are movable with respect to each other, i.e., a one-piece jaw 1 and a support means 2 which also constitutes, in this particular embodiment of the invention, the body of the binding.

The jaw 1 which conventionally comprises two laterally widening wings, is applied, in the rest position, against the rear face of the support means 2 constituting the body of the binding, via an elastic mechanism. This elastic mechanism comprises a spring 3 housed in a longitudinal recess 4 in the body 2 and disposed between the bottom 5 of this recess and a support face 6 of a stopper 7 closing the front orifice of the longitudinal recess 4. This stopper 7 is itself screwed on the threaded end portion of a longitudinal tie-rod 8 which extends axially in the longitudinal housing 4 and passes through a slot 9 made in the rear wall 2*a* of the support means 2, which wall defines the bottom 5.

The tie-rod 8 thus projects rearwardly, outside the rear wall 2*a* of the support means 2, and its rear end portion 8*a* which is flattened, is pierced with an oblong slot 11 in which is housed a tapped sleeve 12 of vertical axis. In this sleeve is screwed the threaded stem of a screw 13 for adjusting the height of the jaw 1. This jaw 1 ends in a forwardly oriented fork comprising two upper and lower horizontal wings 1*a* and 1*b* respectively. Head 13*a* of the height-adjusting screw 13 is partly housed in a hole 14 bored in the upper horizontal wing 1*a* of the jaw 1, whilst the smooth lower end portion 13*b* of the screw 13 is engaged and axially retained in a hole 15 made in the lower horizontal wing 1*b* of the jaw. To this end, the smooth portion 13*b* is disposed and riveted in a shouldered bushing 130 and a washer 131, the shoulder 132 of the bushing 130 and the washer 131 thus forming the vertical holding means. From the foregoing, it is thus seen that rotation in one direction or in another of the screw 13 is translated, as the sleeve 12 is locked in rotation, by vertical translation of this screw. As this latter is connected in translation to the jaw 1, a rotation of the screw 13 therefore causes a vertical displacement of the jaw 1 to ensure the adjustment in height.

According to the invention, the jaw 1 is applied on the support means at three points, namely, an upper point of support A disposed in the longitudinal plane of symmetry x-y of the binding and two lower points of support B and C symmetrical with respect to this plane. The upper point of support A is formed by a cylindrical surface of arc-shaped cross section, this surface being made in which the rear edge of an upper horizontal wing 2*b* of the support means 2. The upper horizontal wing 1*a* of the jaw 1 extends partly above the upper horizontal wing 2*b* of the support means 2 as may be more readily seen in FIG. 1. Consequently, the head 13*a* of the height-adjusting screw 13 is applied against cylindrical support surface A whose radius of curvature is advantageously the same as that of head 13*a*.

The two lower points of support B and C are made in the same manner and are constituted by rearwardly projecting bosses, which are provided in the lower portion of two longitudinal sides 2*c* and 2*d* of the support element 2. These bosses advantageously present cylindrical outer surfaces of rearwardly facing convexity. Grooves 16 and 17 which extend substantially vertically and are provided on either side of the lower horizontal wing 1*b* of the jaw 1 cooperate respectively with these bosses.

Thus, when the jaw 1 is urged forwards by the tie-rod 8 subjected to the action of the spring 3, it is applied by the screw head 13*a* against upper support surface A, and by the two vertical, lateral grooves 16 and 17 against respective lower support bosses B and C.

Such an arrangement constitutes a particularly advantageous embodiment from the point of view of construction, since the head 13*a* of the height-adjusting screw 13 is in fact used as one of the members of the jaw 1 cooperating with the various points of support on the support means 2 connected to the ski.

It is obvious that the arrangement of the support bosses such as B and C and the grooves 16, 17 may be reversed, by providing these bosses on the jaw 1 of the binding and the two grooves on the support means 2.

In the first embodiment which has just been described, the vertical alignment of the jaw 1 on the support means 2 forming the body of the binding is ensured by the tie-rod 8 abutting on the upper edge of the slot 9. In fact, the jaw 1 is permanently connected to the tie-rod 8 by the height-adjusting screw 13 and its upward movement is thus prevented by the abutment of the tie-rod 8 against the upper edge of the slot 9.

Figure 8:
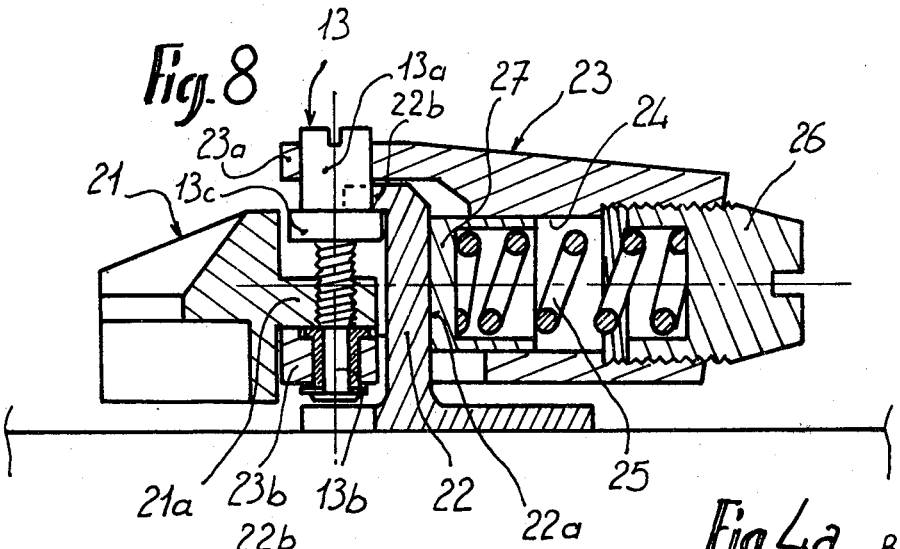
FIG. 8 is a view in vertical, axial section of an alternative embodiment of the safety binding according to the invention.

An alternative embodiment of the binding according to the invention will now be described with reference to FIGS. 8 and 9. This binding comprises a mobile assembly constituted by the jaw 21 and the body 23, this mobile assembly being pivotable about a support means 22 fixed to the ski. The jaw 21 and the body 23 are located respectively to the rear and to the front of the support means 22. The two parts of the mobile assembly 21, 23 are assembled by the height-adjusting screw 13, which extends vertically a little to the rear of the support means 22.

The body 23 of the binding, extending to the front of the support means 22, is pierced with an axial bore 24 with a compression spring 25 disposed therein. This spring abuts, against the front side, on a stopper 26 screwed in a tapping provided at the front end of the axial bore 24 and, on the other side, on a support member 27 such as a piston, mounted to slide in the axial bore 24. This piston 27 is thus pressed by the spring 25 against the front face 22*a* of the support means 22. This front face 22*a* may extend perpendicularly to the ski as shown in FIG. 8, or be inclined upwardly, slightly towards the rear.

The jaw 21 comprises a horizontal wing 21*a* extending forwardly and pierced with a tapped hole in which the threaded stem of the height-adjusting screw 13 is screwed. The head 13 of this screw is partly housed in a hole pierced in a horizontal upper wing 23*a* which extends rearwardly of the body 23. This wing 23*a* is above and in the immediate vicinity of a horizontal wing 22*b* of the support means 22, extending rearwardly. The cylindrical surface constituting the upper point of support A of the assembly formed by the jaw 21 and the body 23 is formed in the rear edge of horizontal wing 22*b*.

The screw 13 comprises, at its lower end, a smooth portion 13*b* which is engaged through a hole pierced in a horizontal transverse wing 23*b* of the body 23, which extends on the rear side with respect to the support means 22. This smooth portion 13*b* is blocked against translation in the transverse wing 23*b*.

Two grooves are disposed symmetrically in wing 23*b* with respect to the longitudinal plane of symmetry x-y, therefore on either side of the smooth portion 13*b* of the screw 13.

Figure 9:
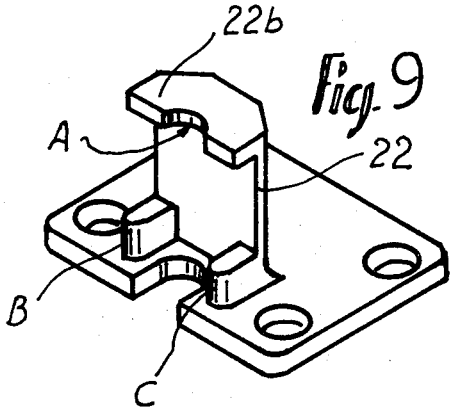
FIG. 9 is a view in perspective of the support means of the safety binding shown in FIG. 8.

Like the grooves 16 and 17 of the jaw in the case of the first embodiment described, these grooves are applied respectively against the two rearwardly projecting bosses B, C provided laterally on the rear face of the support means 22, as may be seen in FIG. 9.

In the embodiment which has just been described with reference to FIGS. 8 and 9, the vertical holding of the mobile assembly formed by the jaw 21 and the body 23 on the support means 22 is ensured by flange 13*c* of the height-adjusting screw 13. This flange 13*c* is located between the head 13*a* of the screw and the threaded stem of this latter and it abuts beneath the upper horizontal wing 22*b* of the support means 22, thus preventing any upward movement of the jaw 21. The jaw is thus immobilised in the desired position, corresponding to the thickness of the sole of the boot.

Figure 12:
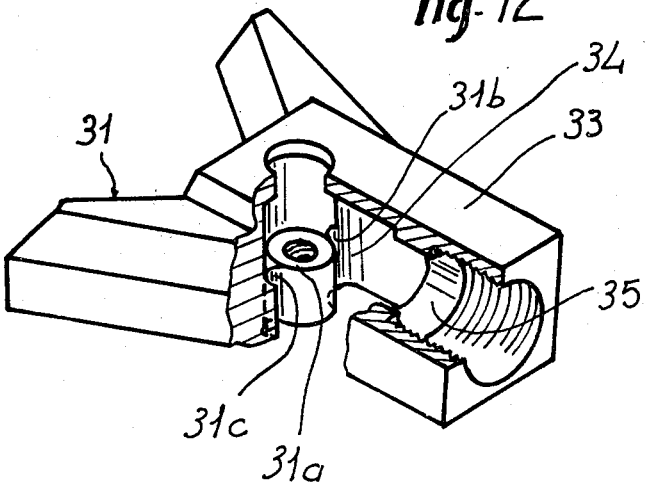
FIG. 12 is a view in perspective of the one-piece assembly constituted by the body and the jaw of the binding according to FIGS. 10 and 11.
Figure 6:
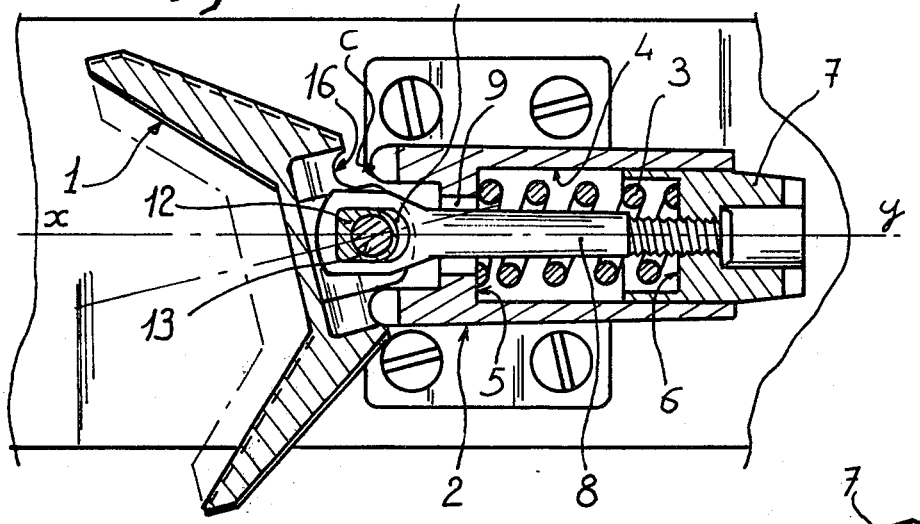
FIG. 6 is a view in horizontal section similar to that of FIG. 2, the binding being shown in position of lateral release.
Figure 7:
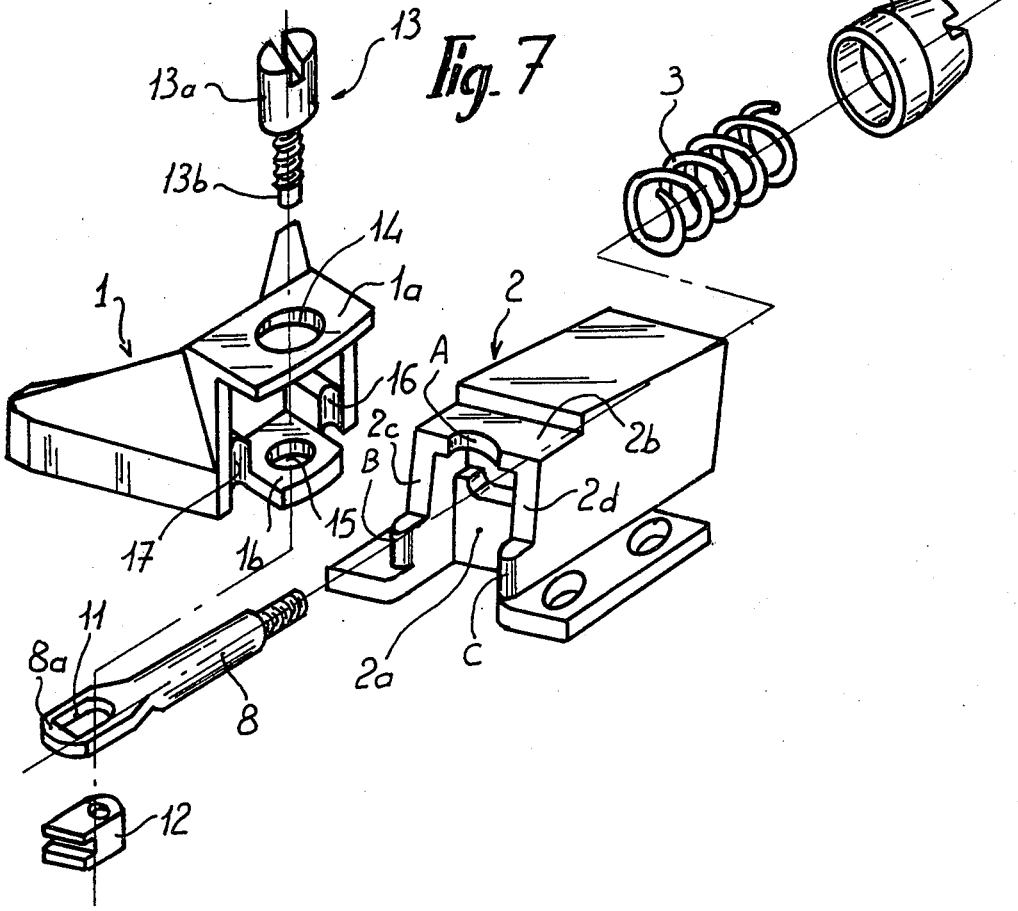
FIG. 7 is an exploded view, in perspective, of the various elements constituting the binding shown in FIGS. 1 to 6.
Figure 10:
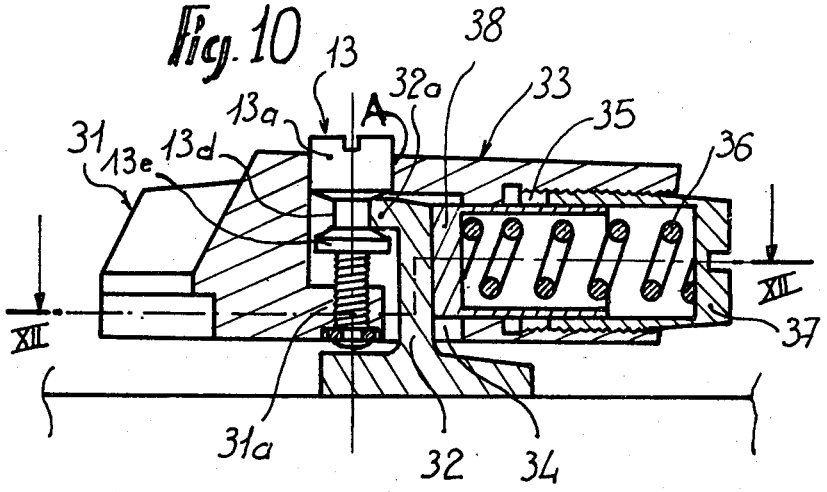
FIG. 10 is a view in vertical axial section of another alternative embodiment of the safety binding according to the invention.
Figure 11:
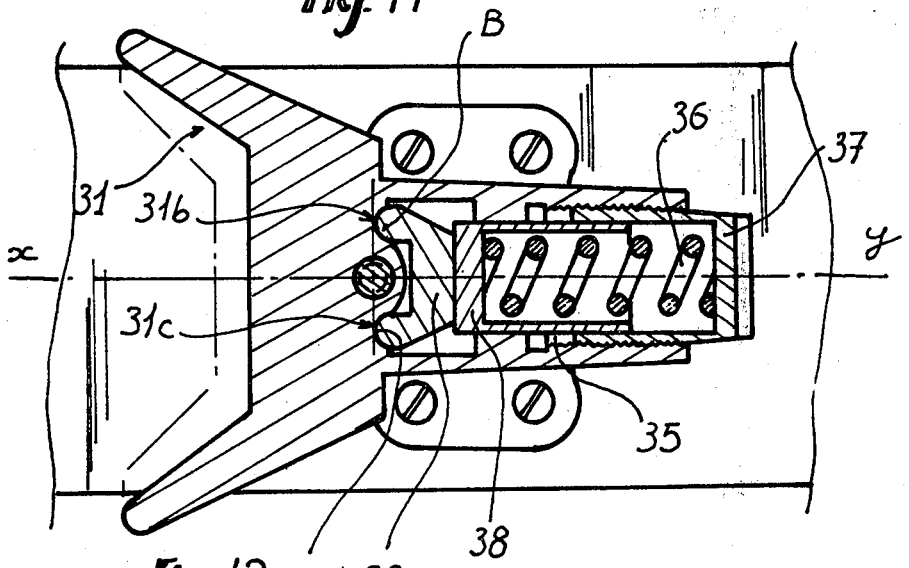
FIG. 11 is a view in horizontal section along line XI—XI of FIG. 10.

In the alternative embodiment shown in FIGS. 10 to 12, the safety binding according to the invention comprises a mobile one-piece assembly constituted by a jaw 31 and a body 33, this assembly being pivotable with respect to a support means 32 fixed to the ski. The jaw 31 and the body 33 are advantageously moulded in one piece, as may be seen more readily in FIG. 12. The body 33 extends forwardly and above the support means 32. This support means 32 is engaged vertically in a recess 34 made in the body 33 and opening downwardly. In this recess opens out an axial bore 35 in which a compression spring 36 is housed. This spring abuts on one side against a stopper 37 screwed in a tapping provided in the bore 35 and, on the other side, against a support member 38, such as a slidably mounted piston. This support member 38 is pressed against the front face of the support means 32.

The height-adjusting screw 13 is screwed, by its threaded system, in a tapped hole provided in a lower portion 31*a* projecting forwardly of jaw 31. At its lower end, the stem of the screw 13 is provided with stop means limiting the downward movement of the assembly 31, 33. The head 13*a* is housed in a hole pierced in the rear part of the body 33 and below this head 13*a* is provided a groove 13*d*, preferably of trapezoidal cross section. In this groove is engaged an upper horizontal wing 32*a* of the support means 32, this wing extending rearwardly. The cylindrical support surface constituting the upper point of support A is provided in this wing.

The lower flange 13*e* which defines the groove 13*d* abuts beneath the upper horizontal wing 32*a* of the support means 32, ensuring the vertical holding of the one-piece assembly formed by the jaw 31 and the body 33.

At its lower portion, the support means 32 presents two bosses symmetrical with respect to the longitudinal plane of symmetry x-y and defining the two lower points of support B and C as in the case of the embodiment described previously. At the level of these two bosses, the jaw 31 presents, on either side of the forwardly projecting central part 31*a*, two grooves *31b*, 31*c* in which the bosses B and C respectively engage.

Although in all the embodiments of the invention which have been described hereinabove the jaw of the binding according to the invention is applied against the upper support surface A via the adjusting screw 13, it may also be envisaged, according to variant embodiments, that it is a projecting portion of the jaw itself which is housed in the cylindrical surface A, the height adjusting screw 13 then being located a little to the rear and not contributing to the support.

Furthermore, in all the embodiments, the shapes of the intercooperating portions may be reversed when constituting the three points of support A, B, C, i.e. a boss may be provided on the support means to constitute the upper point of support A and a recessed portion in the jaw and lower bosses on the jaw cooperating with recessed portions constituting points of support B and C on the support means.

Figure 13:
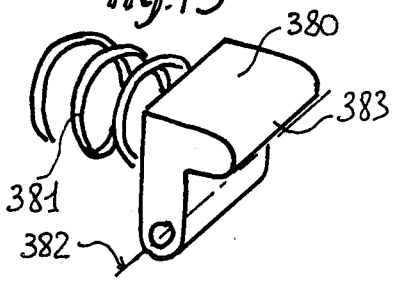
FIG. 13 shows another elastic mechanism in perspective.

FIG. 13 shows another elastic mechanism. In this embodiment the sliding pistons 27 and 38 are replaced by a rocking lever 380 urged by a spring 381. The rocking lever 380 is mounted to rotate with respect to the body 23, 33 about a pin 382. Its rear part 383 is then in abutment on the support means 22, 32.

Figure 4:
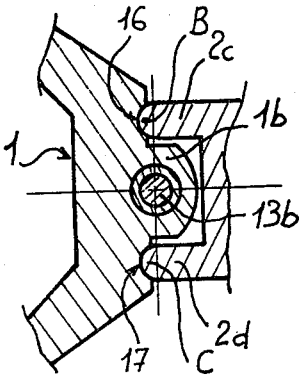
FIG. 4 is a view in horizontal section along line IV—IV of FIG. 1
Figure 5:
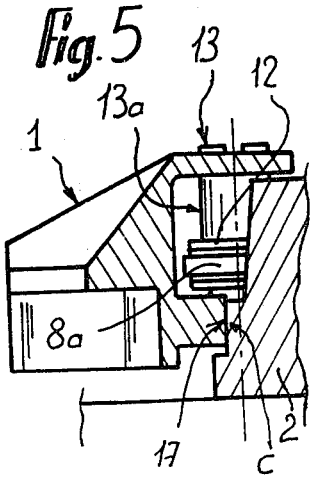
FIG. 5 is a view vertical and partial longitudinal section along line V—V of FIG. 2.
Figure 4A:
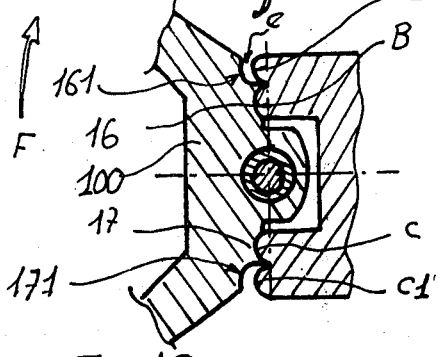
FIG. 4*a* is a view similar to FIG. 4, but showing a variant of the lower supports.

FIG. 4*a* is a view similar to FIG. 4 showing an alternative embodiment of the support means 2. In this embodiment are found two lower supports disposed on either side, namely a support C1 near the support C and a support surface B1 near support surface B. The jaw then comprises, on either side, two corresponding recesses 16–161 and 17–171. Upon release in the direction of F, the jaw 100 will rock first against support B then on support surface B1. A space e is provided to allow this two-step rocking. There is, therefore, on one side a double line of support AB and AB1 and on the other side a double line of support AC and AC1. This arrangement may also be used for the other variants of FIGS. 8 to 12.

It is to be noted that the elastic mechanism is advantageously in abutment on the front face of the support means comprising the lines of support, but it may be otherwise, namely the elastic mechanism may be in abutment on a part fixed to the ski different from the support means comprising the lines of support.

Although in all the embodiments of the invention which have been described hereinabove the jaw 1 is applied directly on the support means fixed to the ski, it may, according to a variant embodiment, be applied on this means indirectly, i.e. by means of an intermediate element connected to the jaw.

What is claimed is:

1. A safety binding for binding a ski boot onto a ski, said binding comprising:

(a) a jaw adapted to engage and hold one end of said boot on said ski;

(b) a support means adapted to be secured to said ski;

(c) elastic means adapted to bias said jaw towards said support means; and wherein said binding comprises two lines of support converging above said ski positioned on opposite sides of the longitudinal plane of symmetry of said binding whereby, during release, said jaw is pivotable alternately along each of said lines of support, and wherein said jaw or an intermediate element associated therewith is biased to pivot relative to said support means at an upper point and at two lower points, said three points forming said two lines of support.

2. The safety binding as defined by claim 1 wherein said upper point is positioned along the longitudinal plane of symmetry of said binding.

3. The safety binding as defined by claim 2 wherein said two lower points of support are symmetrical relative to said longitudinal plane of symmetry whereby said lines of support are each symmetrical relative to said longitudinal plane.

4. The safety binding as defined by claim 1 further comprising an adjustment screw for adjusting the height of said jaw relative to said ski to accommodate boot soles of different thicknesses, and wherein a portion of said adjustment screw is positioned at said upper point between said jaw or said intermediate element and said support means.

5. The safety binding as defined by claim 4 wherein said jaw or said intermediate element, and said support means, are formed so as to have a surface complementary to the surface of said portion of said adjustment screw at said upper point.

6. The safety binding as defined by claim 1 wherein said support means comprises a boss extending therefrom at each of said lower points and wherein said jaw or said intermediate element comprises complementary recessed portions adapted to pivotably seat said bosses.

7. The safety binding as defined by claim 1 wherein said support means comprises a recess at each of said lower points and said jaw or said intermediate element comprises complementary bosses adapted to be pivotably seated in each of said recesses.

8. The safety binding as defined by claim 1 wherein said support means constitutes the body of the binding and is adapted to be secured to said ski, said elastic means being at least partially positioned within said support means, said elastic means further comprising a rod extending from said support means and biased towards said jaw, said rod ending in a flattened portion, and wherein said safety binding further comprises an adjustment screw for adjusting the height of said jaw relative to the ski, said adjustment screw extending through a bore in said rod.

9. The safety binding as defined by claim 8 wherein said adjustment screw has a threaded stem portion, and said threaded stem portion extends through an opening in said rod, whereby adjustment of said adjustment screw results in the translational movement of said adjustment screw relative to said rod.

10. The safety binding as defined by claim 9 wherein said adjustment screw ends in an unthreaded portion, and wherein said jaw comprises a lower flange extending therefrom, said unthreaded portion being translationally secured within said lower flange whereby translational movement of said adjustment screw relative to said rod results in the adjustment of the spacing of said jaw from said ski.

11. The safety binding as defined by claim 10 wherein said jaw or said intermediate portion comprises an opening therein, and wherein a top portion of said adjustment screw extends through said hole, said top portion being biased against said support member at said upper point by the force exerted by said elastic means on said jaw.

12. The safety binding as defined by claim 11 further comprising a threaded sleeve positioned in the opening in said rod, said sleeve threadably securing said adjustment screw while allowing for translational movement of said adjustment screw upon adjustment of said adjustment screw.

13. The safety binding as defined by claim 1 wherein said binding comprises a body portion, and wherein said jaw and said body portion constitute a mobile assembly relative to said support means, said body and said jaw or said intermediate element being connected by an adjustment screw for adjusting the height of said jaw relative to said ski.

14. The safety binding as defined by claim 13 wherein said body has a portion extending above said support means, said body portion comprising an axial bore at least partially containing said elastic means, said elastic means comprising a sliding member pressed by a spring against one surface of the support means.

15. The safety binding as defined by claim 14 wherein said body portion extending above said support means comprises an opening, the top portion of said adjustment screw extending through said opening, and wherein said top portion of said adjustment screw is biased against said upper point by the force exerted by said elastic means on said body.

16. The safety binding as defined by claim 15 wherein said jaw or said intermediate element comprises a flange extending therefrom, said adjustment screw comprising a threaded portion adapted to threadingly engage said flange of said jaw or said intermediate element, whereby rotation of said adjustment screw results in the adjustment of the height of said jaw relative to said ski, while said adjustment screw does not move translationally with respect to said body.

17. The safety binding as defined by claim 16 wherein said adjustment screw is maintained stationary relative to said body by means of a flange on the stem of said adjustment screw, and wherein said upper point is positioned on a wing portion extending from said support means, said wing portion preventing movement of said adjustment screw relative to said body.

18. The safety binding as defined by claim 17 wherein said adjustment screw comprises an unthreaded portion secured beneath said flange of said jaw or said intermediate element, whereby, upon application of said jaw or said intermediate element against said three contact points, adjustment of said screw results in movement of said jaw relative to said ski with said adjustment screw being translationally stationary relative to said support means and said body.

19. The safety binding as defined by claim 1 wherein said binding comprises a body having at least a portion of said elastic means mounted therein, and wherein said body and said jaw form a one-piece assembly adapted to pivot around said support means.

20. The safety binding as defined by claim 19 wherein said body comprises a recess, said support means being adapted to extend within said recess, said body further comprising an axial bore comprising at least a portion of said elastic means therein, said elastic means comprising a slidable member biased against said support means.

21. The safety binding as defined by claim 20 wherein said body-jaw assembly further comprises an opening therein adapted to receive an adjustment screw.

22. The safety binding as defined by claim 21 wherein said adjustment screw comprises a head portion and an intermediate flange portion with a grooved portion positioned between said head and intermediate flange portions, said grooved portion of said adjustment screw being adapted to press against said upper point, said upper point being located on a wing portion extending from said support means.

23. The safety binding as defined by claim 22, wherein said adjustment screw further comprises a threaded stem portion screwed into a central portion projecting from the bottom of said jaw or said intermediate element.

24. The safety binding as defined by claim 1 wherein said elastic means comprises a spring mounted in the body of the binding and a pivotable rocking lever, said rocking lever being pivotably mounted on the body of said safety binding, said pivotable rocking lever being adapted to contact and apply pressure on said support means.

25. The safety binding as defined by claim 1 wherein said two lower points each comprise a double-pivot axis, thereby resulting in a total of four lines of support.

* * * * *

UNITED STATES PATENT AND TRADEMARK OFFICE

CERTIFICATE OF CORRECTION

PATENT NO. : 4,345,776

DATED : August 24, 1982

INVENTOR(S) : Georges P. J. SALOMON

It is certified that error appears in the above-identified patent and that said Letters Patent is hereby corrected as shown below:

Column 1, line 29, "to" should be deleted;
line 32, "effort" should be deleted; and Column 4, line 6, "against" should be --on--; and
line 6, "on" should be --against--.

Signed and Sealed this

*Fifteenth* Day of *March 1983*

[SEAL]

*Attest:*

GERALD J. MOSSINGHOFF

*Attesting Officer*

*Commissioner of Patents and Trademarks*